United States Patent [19]

Kaufman

[11] 4,008,550

[45] Feb. 22, 1977

[54] DEVICE FOR SETTING SOCKETS FOR SWIMMING POOL LADDERS

[76] Inventor: Samuel Kaufman, P.O. Box 1124, Hagerstown, Md. 21740

[22] Filed: Sept. 19, 1974

[21] Appl. No.: 507,608

[52] U.S. Cl. ..... 52/298; 182/87

[51] Int. Cl.[2] ..... E02D 27/00

[58] Field of Search ..... 182/87, 93, 129, 230; 52/298, 297, 296

[56] References Cited

UNITED STATES PATENTS

| | | | |
|---|---|---|---|
| 673,327 | 4/1901 | Reeve | 52/298 |
| 2,974,746 | 3/1961 | Baker | 182/93 |
| 3,023,832 | 3/1962 | Silverman | 182/93 |
| 3,065,820 | 11/1962 | Prizler | 182/93 |
| 3,299,984 | 1/1967 | Svedahl | 182/92 |
| 3,420,558 | 1/1969 | Whitten | 182/93 |

*Primary Examiner*—Reinaldo P. Machado
*Attorney, Agent, or Firm*—Watson, Cole, Grindle & Watson

[57] ABSTRACT

For setting the sockets for swimming pool ladders in the deck of the pool, a pair of sockets is provided which are connected to a channel bar formed of sheet metal with upwardly directed and inwardly slanting longitudinal flanges. This is then set at the proper position, and secured to the ground by deformed steel rods running through holes in the sheet metal. The channel is filled with grout which when set holds the bar and the sockets securely in place. The sockets are filled with sand, which is removed by the use of a hose after the deck has been poured, screeded and cured.

1 Claim, 4 Drawing Figures

DEVICE FOR SETTING SOCKETS FOR SWIMMING POOL LADDERS

BACKGROUND OF THE INVENTION

1. Field of the Invention

The invention relates to an arrangement for positioning the sockets for swimming pool ladders properly in the deck before the concrete of the deck is placed, to allow for the concrete to cure around them without the possibility of their being disturbed.

2. The Prior Art

In the past, in order to position the sockets of swimming pool ladders properly, it has been the general practice to use the ladder itself as a positioning arrangement. This has a number of disadvantages. One of these is that the positioning of the sockets is difficult unless the ladder is already present on the job at the time the deck is poured. If the ladder is accidentally struck, or if someone uses it to try to climb from the pool, before the concrete of the deck is cured, there is a likelihood that the sockets will be loosened and that the ladder, when the concrete is cured, will be loose and cannot be made fully secure again.

SUMMARY OF THE INVENTION

The present invention provides an arrangement which avoids the disadvantages of the prior art, and which permits the installation of the ladder sockets without the presence of the ladder itself, and without the danger of their being loosened.

This is accomplished by mounting the sockets on a connecting member, which is a piece of sheet metal having upwardly extending and inwardly bent longitudinal flanges, with holes therethrough. The sockets are secured to the channel bar at the proper distance for receiving the ends of the ladder, and the unit so formed is laid on the ground and deformed steel rods are driven through some of the holes into the ground. The channel is then filled with grout, which, after it has set, will engage the ends of the anchor rods and will position the bar and the sockets firmly in the proper places, which have been measured from the edge of the coping.

After the deck is poured and screeded, the socket will remain in a fixed position during the curing of the concrete of the deck and their loosening is made practically impossible.

DESCRIPTION OF THE PREFERRED EMBODIMENTS

Figure 1:
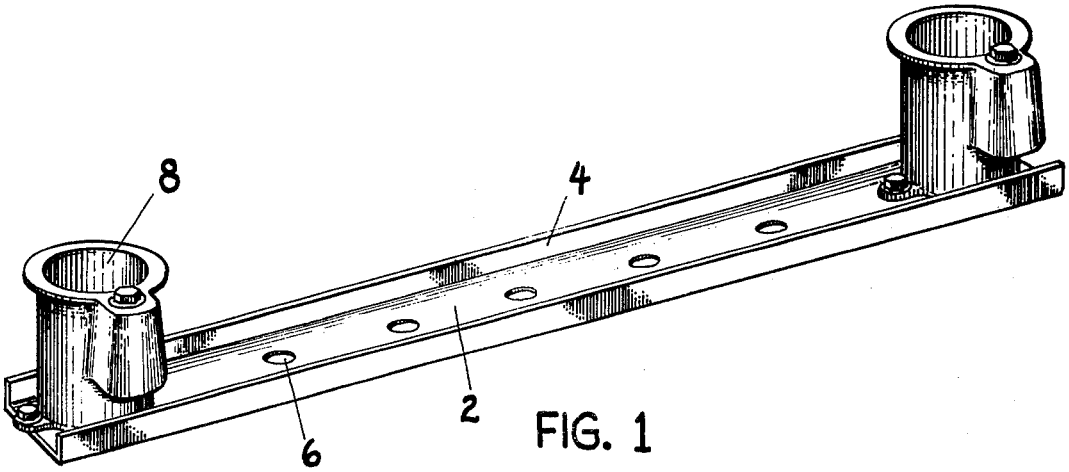
FIG. 1 shows in perspective a device embodying the invention.

As shown in the drawings, the arrangement includes a channel member composed of a main section 2 provided with holes 6 therein and having upwardly extending and inwardly bent longitudinal sides 4. Secured, for example by bolts or rivets at each end of the member 2 are sockets 8 of conventional type for a swimming pool ladder.

Figure 2:
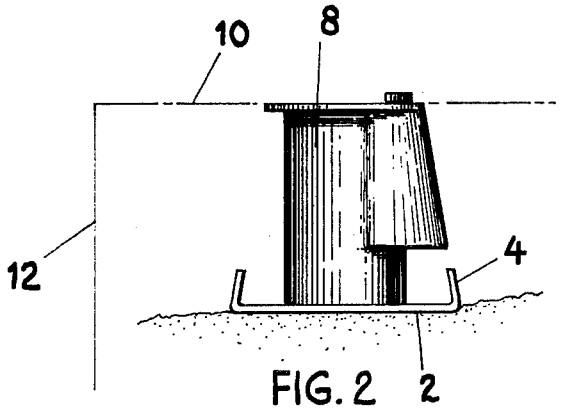
FIG. 2 shows an end view of the arrangement in position of use.
Figure 3:
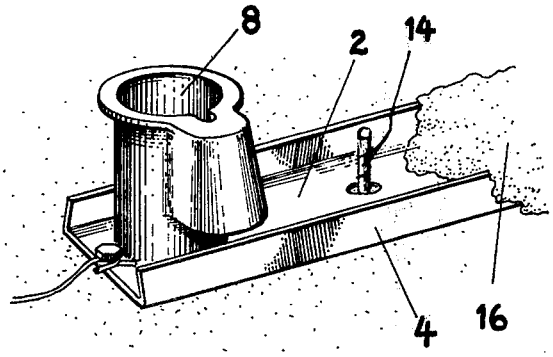
FIG. 3 shows the device being filled with grout.
Figure 4:
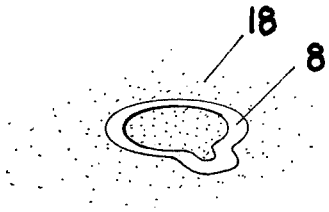
FIG. 4 shows in perspective the socket embedded in the deck after the deck is poured and screeded.

This device is used as follows:

Referring to FIG. 2, the earth at the position where the sockets are to go is packed, and the device is laid thereon with the upper edge flush with the level 10 which is to be the level of the deck, and at a measured distance from the edge of the coping 12. The wedge, screw and washer which are used to secure the ladder in the socket are then dropped into the socket and the socket is filled with sand. Deformed steel rods 14 are then driven through some of the holes, and the channel is filled with grout 16 which is allowed to cure. This then holds the unit firmly in its proper position, the inward slanting of the flanges being particularly effective in holding the grout in the channel and preventing displacement of the unit.

After the deck 18 has been poured and screeded, and the concrete of the deck has cured, the sand is washed out of the socket with a hose and the wedge, screw and washer are immediately available for securing the ladder in place.

I claim:

1. An arrangement for setting sockets for swimming pool ladders comprising an elongated channel member having two sockets carried thereby at the proper distance to receive the ends of a ladder, such channel member comprising a body portion having holes therein in an area outside the area of the sockets and having upwardly directed and inwardly bent longitudinal flanges, whereby, when deformed rods are driven through some of the holes and the channel is filled with grout, the unit is held firmly in proper position during the pouring and curing of the deck.

* * * * *